United States Patent [19]

Haupenthal

[11] Patent Number: 4,615,265

[45] Date of Patent: Oct. 7, 1986

[54] TRANSFER DRUM FOR CONVEYING SHEETS

[75] Inventor: Rudi Haupenthal, Epfenbach, Fed. Rep. of Germany

[73] Assignee: Heidelberger Druckmaschinen AG, Heidelberg, Fed. Rep. of Germany

[21] Appl. No.: 735,571

[22] Filed: May 17, 1985

[30] Foreign Application Priority Data

May 17, 1984 [DE] Fed. Rep. of Germany ..... 3418303

[51] Int. Cl.[4] ..... B41F 9/00

[52] U.S. Cl. ..... 101/142; 271/11; 271/95; 271/900; 101/415.1

[58] Field of Search ..... 101/142, 410, 382 MV, 101/415.1; 271/94–96, 106, 276, 277, 196, 900, 275, 20, 112, 11; 294/64.1

[56] References Cited

U.S. PATENT DOCUMENTS

| | | | |
|---|---|---|---|
| 2,325,774 | 8/1943 | Hohl | 271/96 X |
| 3,599,541 | 8/1971 | Allen | 271/95 X |
| 3,669,445 | 6/1972 | Wallis | 271/106 |
| 3,937,458 | 2/1976 | Langen | 271/95 |
| 4,024,814 | 5/1977 | Becker | 101/410 |
| 4,428,793 | 1/1984 | Sato et al. | 271/106 |
| 4,542,894 | 9/1985 | Feldkamper et al. | 271/95 |

FOREIGN PATENT DOCUMENTS

| | | | |
|---|---|---|---|
| 183765 | 4/1955 | Austria | 271/94 |
| 1277655 | 9/1968 | Fed. Rep. of Germany | 271/94 |
| 2403469 | 9/1974 | Fed. Rep. of Germany | 271/106 |
| 2610480 | 9/1976 | Fed. Rep. of Germany | 271/106 |

*Primary Examiner*—E. H. Eickholt

*Attorney, Agent, or Firm*—Laurence Greenberg; Herbert L. Lerner

[57] ABSTRACT

Transfer cylinder for conveying a sheet from one printing unit to another, comprising a cylindrical drum, a row of rubber suction pads for temporarily holding the sheet, the row of suction pads being disposed at an end of a sheet format length on the cylindrical surface of the drum, the rubber suction pads extending in axial direction of the drum, and paper supports disposed in vicinity of the rubber suction pads for respectively applying suction to and supporting the sheet.

6 Claims, 11 Drawing Figures

TRANSFER DRUM FOR CONVEYING SHEETS

The invention relates to a transfer drum or cylinder for conveying sheets from one printing unit of a printing machine to another. Either one transfer drum is provided between two printing units on three transfer drums are so disposed, at least the middle transfer drum thereof having double the diameter of either of the outer transfer drums. The larger middle transfer drum can thereby be used selectively for first form and perfector printing as well as for a storage cylinder.

Guidance of the sheet on the transfer drum is not without problems. For example, when a sheet is transferred from the second or middle transfer drum to the third transfer drum, instability in the sheet guidance often occurs, so that the freshly printed side of the sheet becomes smeared on the surface of the third transfer drum. In such a case reference is made to a so-called forward falling of the sheet because the latter, after transfer, slides downwardly of its own weight on the outer cylindrical surface of the second or middle transfer drum.

Stiffer sheets and cardboard, furthermore, have a tendency not to conform to the curvature of the outer cylindrical surface of the transfer drum. The radially outwardly flapping sheet ends can consequently strike against structural components which are mounted in vicinity of the transfer drum, such as traverses or cross bars, photoelectric cells, blow-hole rods, and the like. The sheets are thereby not merely smeared but are, in fact, often damaged.

Even the mere removal of internal stresses in cardboard during the transfer operation will cause relative movements between the outer cylindrical surface of the transfer drum and the freshly printed underside of the cardboard. Of course, the print is also smeared thereby. Attempts to solve this problem by employing rubber suction pads or suckers to apply suction to and thereby tightly hold the trailing region of the sheet has led only to partial success because the rubber suckers or suction pads are damaged by the material being printed, especially when that material is cardboard. It is not possible, however, to form a vacuum with damaged rubber suckers or suction pads. After just a few thousand printings, the condition reached is again the same as if there were no rubber suckers or suction pads. It is especially disadvantageous that the failure of the rubber suction pads or suckers does not become aparent to the printer until after a great member of prints have already been ruined by smearing and other damage.

It is accordingly a object of the invention to provide a transfer drum for conveying sheets which is reliable and safe against smearing and damage.

With the foregoing and other objects in view, there is provided, in accordance with the invention, a transfer cylinder for conveying a sheet from one printing unit to another, includes a cylindrical drum, a row of rubber suction pads for temporarily holding the sheet, the row of suction pads being disposed at an end of a sheet format length on the cylindrical surface of the drum, the rubber suction pads extending in axial direction of the drum, and paper supports disposed in vicinity of the rubber suction pads for respectively applying suction to and supporting the sheet.

Besides stabilizing the sheet travel, the invention avoids the requirement for down time to replace the rubber suction pads and also avoids the production of waste paper due to errors in the transfer of the sheet from transfer from to transfer drum or from transfer drum to impression cylinder. After the sheet has been released from the rubber suction pad, the paper support prevents renewed contact thereof with the latter so that the sheet rolls off on the supporting surface of the paper support and does not engage the suction lips of the rubber suction pads. Consequently, the sheet cannot damage the rubber suction pad.

In accordance with another feature of the invention, the paper supports have respective supporting edges disposed in a common plane with suction lips of the rubber suction pads when suction is applied to the sheet by the suction pads.

In accordance with a further feature of the invention and in order to provide proper guidance of the trailing edge of the sheet, the supporting edges have an arcuate shape and extend out of the common plane with the suction lips in a radial direction into the cylindrical drum when suction is applied to the sheet by the suction pads.

In accordance with an added feature of the invention and in order to achieve an especially smooth and stable guidance of the sheet, a respective one of the paper supports is disposed adjacent each of the rubber suction pads as viewed in axial direction of the cylindrical drum.

In accordance with yet another feature of the invention, the rubber suction pads are formed with respective suction bodies, and a respective one of the support plates is fastened to each of the suction bodies.

In accordance with yet a further feature of the invention, the rubber suction pads are formed with respective suction bodies, and a journal extends axially to the cylindrical drum and is fastened to the suction bodies, the support wheels being rotatably mounted on the journal.

In accordance with a concomitant feature of the invention, the cylindrical drum is disposed between two other cylindrical drums of given diameter, the first-mentioned cylindrical drum having a diameter double the given diameter of the two other cylindrical drums and carrying two rows of the rubber suction pads offset from one anoher by 180° on the circumference of the first-mentioned cylindrical drum and being adjustable to a variable sheet format size, the paper supports being formed as support plates fastened to respective suction bodies adjacent each of the rubber suction pads, respectively.

In accordance with another aspect of the invention, there are provided, a row of rubber suction pads each having a respective suction body, and a respective paper support secured to each of said suction bodies and disposed in vicinity of said rubber suction pads for respectively supporting and applying suction to a sheet.

Other features which are considered as characteristic for the invention are set forth in the appended claims.

Although the invention is illustrated and described herein as embodied in Transfer drum for conveying sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
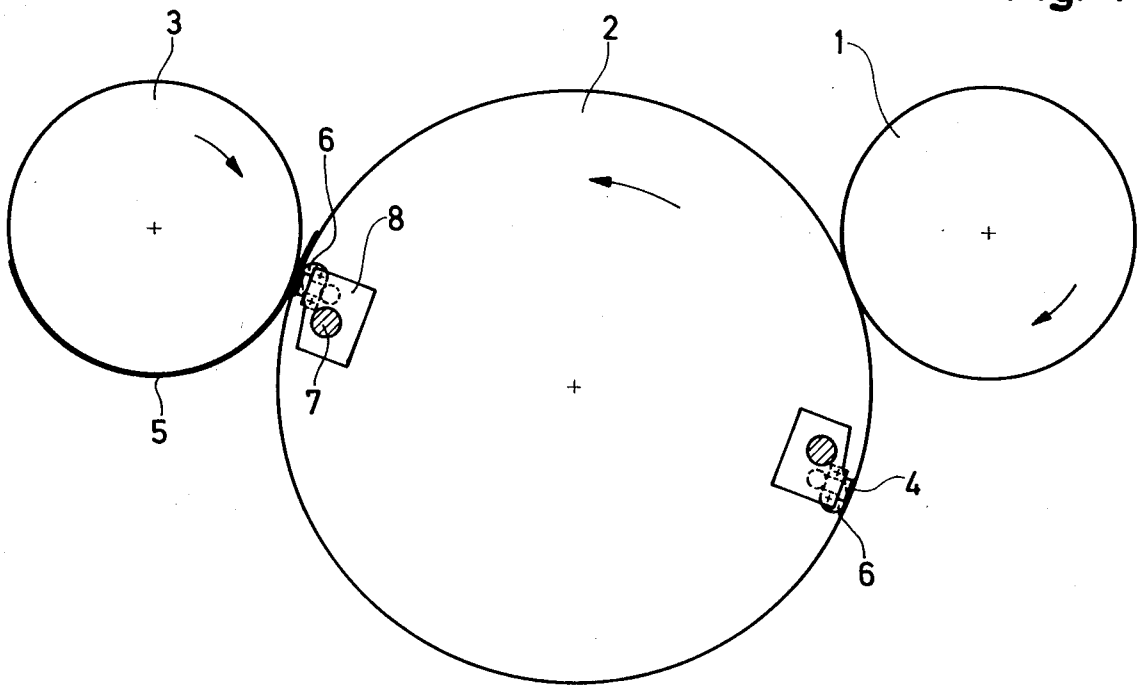
FIG. 1 is a sheet transfer device formed of three transfer drums or cylinders including the transfer drum constructed in accordance with the invention.

Referring now to the drawing and first, particularly, to FIG. 1 thereof, there is shown therein a sheet transfer unit or device formed of a first transfer drum or cylinder 1, a second transfer drum 2 and a third transfer drum 3, the second transfer drum 2 being located in the middle between the other transfer drums 1 and 3. The middle transfer drum 2 has twice the diameter of either of the transfer drum 1 and 3 and is provided with two rows of rubber suckers or suction pads 4 extending parallel to the rotational axis and distributed uniformly over the circumference of the middle transfer drum 2. These rubber suction pads 4 serve for temporarily holding the trailing region of a sheet 5 which is being transferred. The rubber suction pads 4 prevent the sheet 5, for example, from falling through the gap or nip between the transfer drums 2 and 3 after transfer of the sheet 5 has occurred. Such sliding through or forward falling of the sheet 5 usually causes smearing of the printed sheet or even damage thereto. In order to prevent damage to the rubber suction pads 4 when the trailing edge of the sheet 5 is pulled off, paper supports or carriers 6 are disposed adjacent the rubber suction pads 4.

Figure 2:
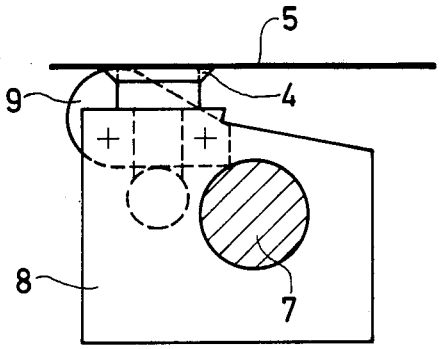
FIG. 2 is an enlarged fragmentary view of FIG. 1 showing the front side of a rubber suction pad with a support plate carried by the transfer drum according to the invention.
Figure 3:
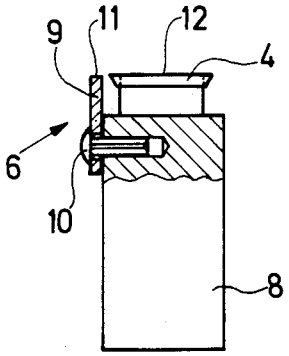
FIG. 3 is a side view, partly broken away and partly in section, of FIG. 3.

FIGS. 2 and 3 show, in front and side views, the construction of the rubber sucker or suction pad 4, and a paper support or carrier 6 in respective side and front views. Suction bodies 8 are mounted on a traverse or cross bar 7 extending parallel to the axis of rotation of the transfer cylinder 2. Each of the suction bodies 8 carries a respective rubber sucker or suction pad 4. The paper support or carrier 6, which is formed as a support plate is fastened by rivets 10 to a side of the suction body 8 directly adjacent the rubber suction pad 4. A supporting edge 11 of the support plate 9 then lies in one plane with a suction lip 12 of the rubber suction pad 4 when suction is applied by the rubber suction pad 4 to the sheet 5. The supporting edge 11 of the support plate 9 extends arcuately downwards i.e. in a radial direction into the transfer cylinder 2. This arcuate construction of the supporting edge 11 affords a better rolling of the sheet 5 thereon. The supporting edge 11 is arcuately shaped, moreover, so that the sheet 5 which has been pulled off therefrom cannot press against fixed parts of the suction body 8. Due to the arrangement of the support plate 9 as well as the formation of the supporting edge 11, sequeezing and consequent damaging of the rubber suction pads 4 are not possible.

Figure 4:
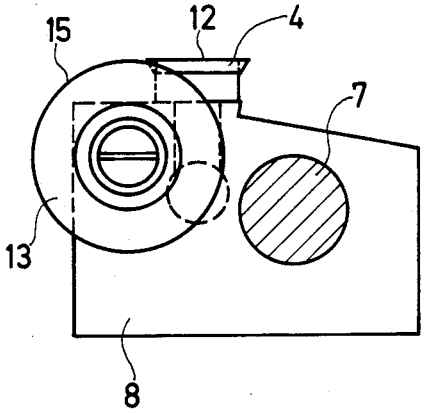
FIG. 4 is a view like that of FIG. 2 of another embodiment of the rubber suction pad having support wheels.
Figure 5:
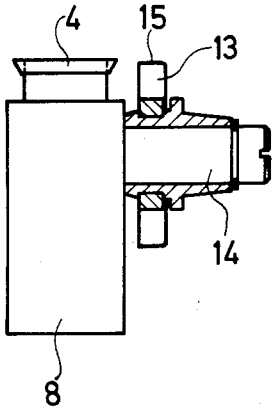
FIG. 5 is a side view, partly in section, of FIG. 4.

Another embodiment of the paper support or carrier 6 is shown in FIGS. 4 and 5. The suction body 8 of the rubber suction pad 4 is mounted on a traverse or cross bar 7 in the same manner as in the aforedescribed embodiment of FIGS. 2 and 3. Instead of the support plate 9 of the first embodiment, however, a support wheel 13 is provided directly adjacent each rubber suction pad 4 in the embodiment of FIGS. 4 and 5. The support wheel 13 is rotatably mounted on a journal 14 which is fastened to the suction body 8 and extends parallel to the traverse or cross bar 7. The support wheel 13 has a supporting surface 15 which extends upwardly so far that the suction lips 12 and the supporting surface 15 are disposed in a common plane when suction is applied by the rubber suction pad 4 to a sheet. The arrangement of the support wheel 13 on the suction body 8 relative to the rubber suction pad 4 is such that the trailing edge of the pulled-off sheet 5 always rests on the supporting surface 15 of the support wheel 13 without damaging the suction lip 12 of the rubber suction pad or sucker 4.

Figure 6:
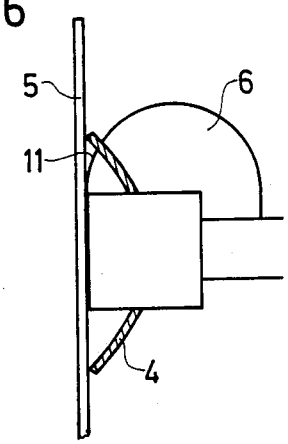
FIGS. 6 to 8 are diagrammatic views of the rubber suction pad disposed in horizontal position which show how the paper support thereof functions when a sheet end is drawn off.
Figure 7:
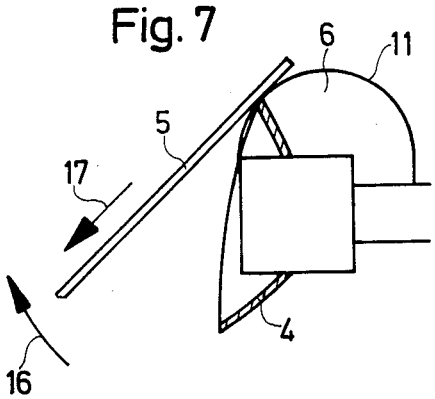
Figure 8:
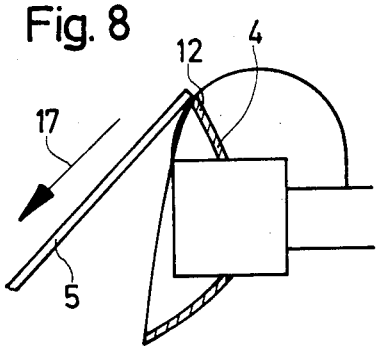

FIGS. 6 to 8 illustrate more clearly the manner of operation or function of the paper support or carrier 6 irrespective of its construction as a support plate 9 or as a support wheel 13. As is shown in FIG. 6, when suction is applied to the sheet 5, the latter lies on the supporting edge 11. In FIG. 7, suction is no longer applied by the rubber suction pad 4, the sheet 5 has consequently been released and moves, on one hand, in direction of the arrow 16 i.e. swings away from the rubber suction pad 4, the sheet 5 being supported, in the region of the trailing edge thereof, on the supporting edge 11 of the paper support 6. On the other hand, the sheet 5 is simultaneously pulled off, however, in direction of the arrow 17. The trailing print-free surface portion of the sheet 5 slides along on the supporting edge 11 of the paper support 6 without being able to damage the suction lip 12 of the rubber suction pad 4, as shown in FIG. 8. Especially when so-called cardboard is being processed, this guidance of the cardboard sheet at the trailing edge thereof has a stabilizing effect upon the conveying motion so that relative movements between the outer cylindrical surface of the transfer drum taking over the cardboard sheet and the printed underside of the cardboard sheet can be avoided.

Figure 9:
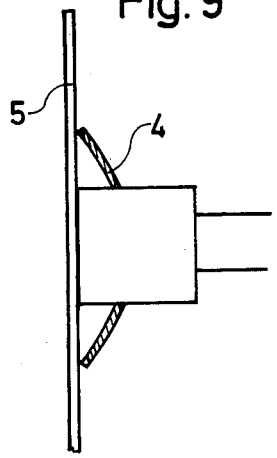
FIGS. 9 to 11 are corresponding diagrammatic views of a rubber suction pad without the paper support according to the invention and the protection it affords.
Figure 10:
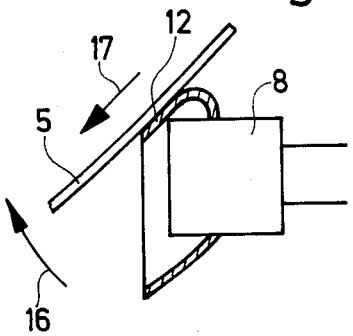
Figure 11:
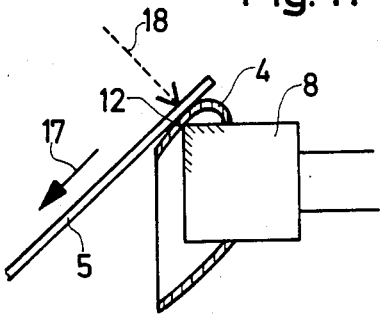

The situation is different, as is shown in FIGS. 9 to 11, when no paper supports 6 are provided. The sheet 5 then presses the suction lip 12 against an edge of the suction body 8. In this regard, the sheet 5, as shown in FIG. 7, is simultaneously moved in direction of the arrow 16 and the arrow 17. Because a stiff sheet or cardboard, in the final phase of the sheet transfer, presses with considerable force in direction towards the rubber suction pad 4, as indicated by arrow 18 shown with a broken line, yet is also moved simultaneously farther in the direction of an arrow 17, an abrasive movement between the suction lip 12 and an edge of the suction body 8 occurs. A consequence thereof is that just after a few thousand printings, the suction lip 12 is damaged to an extent that a hole is formed therein. The instant that the suction lip 12 of the rubber suction pad 4 is perforated or broken through, it is no longer possible for a vacuum to be generated, and the rubber suction pad 4 loses its effect. The failure of such damaged rubber suction pads 4 is usually unnoticed by the printer until a relatively large member of sheets have already become ruined by smearing.

As mentioned hereinbefore, the invention is not restricted to the illustrated embodiments. For example, the paper supports or carriers 6 may also be formed as stirrups with roughened and chrome-plated surfaces.

The foregoing is a description corresponding, in substance, to German application P No. 34 18 303.5, dated May 17, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Transfer cylinder for conveying a sheet from one printing unit to another, comprising a cylindrical drum, a row of rubber suction pads formed with suction lips for temporarily holding a conveyed sheet, said row of suction pads being disposed at an end of a sheet format length on sheet guiding surfaces formed on said drum, said row of rubber suction pads extending in axial direction of said drum, and paper supports disposed in vicinity of said rubber suction pads for respectively supporting the conveyed sheet at least while it is being pulled off the suction lips, said paper supports having respective supporting edges, a part of which is disposed in a common plane with said suction lips of said rubber suction pads when suction is applied to the sheet by said suction pads, another part of said supporting edges having an arcuate shape and extending out of said common plane with said suction lips in a radial direction into said cylindrical drum, the conveyed sheet having an underside which is disposed in said common plane when suction is applied to the sheet.

2. Transfer cylinder according to claim 1 wherein said paper supports are formed as support plates.

3. Transfer cylinder according to claim 1 wherein said paper supports are formed as support wheels.

4. Transfer cylinder according to claim 3 wherein said rubber suction pads are formed with respective suction bodies, and including a journal extending axially to said cylindrical drum and fastened to said suction bodies, said support wheel being rotatably mounted on said journal.

5. Transfer cylinder assembly according to claim 1, wherein said cylindrical drum is disposed between two other cylindrical drums of given diameter, said first-mentioned cylindrical drum having a diameter double the given diameter of the two other cylindrical drums and carrying two rows of said rubber suction pads offset from one another by 180° on the circumference of said first-mentioned cylindrical drum and being adjustable to a variable sheet format size, said paper supports being formed as support plates fastened to respective suction bodies adjacent each of said rubber suction pads, respectively.

6. In combination, on a cylindrical drum, a row of rubber suction pads each having a respective suction body formed with suction lips, and a respective paper support secured to each of said suction bodies and disposed in vicinity of said rubber suction pads for respectively supporting and applying suction to a sheet having an underside disposed in a common plane with an edge of said paper support and said suction lips, said paper support edge having an arcuately shaped part thereof extending out of said common plane and into said cylindrical drum.

* * * * *